US005727529A

United States Patent [19]

Tuckey

[11] Patent Number: 5,727,529

[45] Date of Patent: Mar. 17, 1998

[54] PRESSURE CONTROL VALVE FOR A FUEL SYSTEM

[75] Inventor: Charles H. Tuckey, Cass City, Mich.

[73] Assignee: Walbro Corporation, Cass City, Mich.

[21] Appl. No.: 438,196

[22] Filed: May 9, 1995

Related U.S. Application Data

[63] Continuation-in-part of Ser. No. 398,215, Mar. 2, 1995, Pat. No. 5,579,739, which is a continuation-in-part of Ser. No. 181,848, Jan. 14, 1994, Pat. No. 5,458,104, which is a continuation-in-part of Ser. No. 262,847, Jun. 21, 1994, Pat. No. 5,398,655.

[51] Int. Cl.[6] ..... F02M 37/04

[52] U.S. Cl. ..... 123/514; 123/497; 137/116

[58] Field of Search ..... 123/497, 514, 123/510, 509, 463, 456, 116, 549; 137/116, 549, 510

[56] References Cited

U.S. PATENT DOCUMENTS

| | | | |
|---|---|---|---|
| Re. 35,040 | 9/1995 | DuBois | 236/92 |
| 3,983,894 | 10/1976 | Sheppard | 137/116 |
| 3,989,060 | 11/1976 | Hughes | 137/484 |
| 4,228,777 | 10/1980 | Hasse | 123/454 |
| 4,257,378 | 3/1981 | Bascie, Jr. | 123/512 |
| 4,310,142 | 1/1982 | Ludwig | 137/549 |
| 4,317,467 | 3/1982 | Heyland | 137/508 |
| 4,435,151 | 3/1984 | Matumoto et al. | 431/90 |
| 4,551,128 | 11/1985 | Hakim et al. | 604/9 |
| 4,747,388 | 5/1988 | Tuckey . | |
| 4,829,964 | 5/1989 | Asayama | 123/463 |
| 4,920,942 | 5/1990 | Fujimori | 123/497 |
| 4,926,829 | 5/1990 | Tuckey . | |
| 5,078,167 | 1/1992 | Brandt et al. | 137/549 |
| 5,148,792 | 9/1992 | Tuckey . | |
| 5,220,941 | 6/1993 | Tuckey . | |
| 5,265,644 | 11/1993 | Tuckey . | |
| 5,398,655 | 3/1995 | Tuckey | 123/497 |
| 5,433,241 | 7/1995 | Robinson | 137/115 |
| 5,435,344 | 7/1995 | Robinson et al. | 137/508 |
| 5,435,345 | 7/1995 | Robinson et al. | 137/508 |
| 5,509,390 | 4/1996 | Tuckey | 123/497 |
| 5,558,063 | 9/1996 | Minagawa | 123/497 |

*Primary Examiner*—Carl S. Miller

*Attorney, Agent, or Firm*—Barnes, Kisselle, Raisch, Choate, Whittemore & Hulbert

[57] ABSTRACT

A bypass pressure control unit for use in bypass relation to a fuel delivery line of a pump operated fuel delivery system for an internal combustion engine. The unit includes a housing that encloses a flexible diaphragm valve for defining with the housing a first bypass outlet chamber and a second fuel inlet chamber. The housing has a fuel inlet for communicating the second chamber with the fuel delivery line. The regulating valve is a flexible diaphragm membrane biased by a spring into direct engagement with a relatively large diameter valve seat formed in the housing so that the diaphragm itself acts as a valve member. The diaphragm is movable against spring force by a given pressure of fuel in the second chamber to disengage the diaphragm from the valve seat to thereby communicate the second chamber with the bypass fuel outlet. In one embodiment, the fuel outlet is formed in the housing and has a restricted orifice downstream of the valve seat. In a second embodiment, the fuel outlet is formed in the diaphragm itself so that bypass fuel is communicated to the first chamber from the second chamber through the diaphragm orifice and through an opening in the spring chamber of the housing back to the fuel canister. The unit is operable in an engine fuel system as a bypass maximum pressure relief control, a pulse dampener, fuel accumulator, closed system fuel pressurizer and/or system continuous bypass pressure regulator.

27 Claims, 2 Drawing Sheets

PRESSURE CONTROL VALVE FOR A FUEL SYSTEM

REFERENCE TO COPENDING APPLICATIONS

This is a continuation-in-part of U.S. patent application Ser. No. 08/398,215 filed on Mar. 2, 1995, now U.S. Pat. No. 5,579,739 issued Dec. 3, 1996 which is a continuation-in-part of U.S. patent applications Ser. Nos. 08/181,848 filed on Jan. 14, 1994, now U.S. Pat. No. 5,458,104 issued Oct. 17, 1995 and 08/262,847 filed on Jun. 21, 1994, now U.S. Pat. No. 5,398,655.

FIELD OF THE INVENTION

This invention relates to bypass pressure regulators and more particularly to a pressure regulator for controlling maximum pressure of liquid fuel delivery from a fuel pump to the injectors of an automotive engine.

BACKGROUND OF THE INVENTION

In many engines with fuel injection systems, it is desirable to supply liquid fuel to the injector or injectors from a fuel pump at a controlled pressure which is substantially constant or varies as a function of manifold pressure regardless of the flow rate of fuel supplied by the injectors to the engine, each of which may vary with engine speed, load and other operating conditions. Such systems typically include a check valve positioned in the fuel line between the pump outlet and the engine injectors for preventing reverse flow from the injectors to the pump. In most if not all of such systems it is necessary to provide a pressure relief valve connected to the fuel line between the check valve and the engine for returning fuel from the line to the supply in the event of excessive over-pressure in the fuel line.

Additionally, in some fuel delivery systems of this type a bypass regulator is utilized to provide a continuous open fuel flow path from the pump outlet parallel to the fuel line, such that fuel continues to flow through the bypass and the pump continues operation even in the absence of fuel demand at the engine. In this way, the pump can be continuously operated to maintain a minimum level of operation so as to be able to rapidly accommodate an increasing demand for fuel at the engine. See for example U.S. Pat. Nos. 4,926,829 and 5,148,792, which are incorporated herein by reference.

The fuel pump in such systems typically is of the rotary pump type. In the pumping cycle of a rotary pump, one pumping cell exhausts as another cell is taking in fluid at the same time. Thus, intake and exhaust pressure waves are timed with one another so that the quantity of fluid exhausted from each cell is the same as that taken in by another cell. Hence, it is an inherent characteristic of a rotary pump to produce slight pressure pulses each time one of the multiple vanes passes through its pumping cycle. Consequently, an audible humming noise may result when the pump is operating under system pressure. The noise may increase as the output pressure requirement is increased. Fuel pumps are frequently mounted in the fuel tank of a vehicle which tends to amplify the noise produced by the pump.

In such fuel delivery and injector systems, inertia of the fuel supplied to the injectors can introduce transient delays in the fuel flow to the injectors when responding to changing engine fuel demand. Undesirable fuel pressure pulsations and noise can also be generated and reflected back down the fuel line from operation of the injectors.

It is preferable that such pressure pulses be reduced or eliminated in order to achieve a quiet, smooth, pulse free flow of fluid out of the pump at a desired operating pressure. To overcome these problems various pulse dampening devices have been provided as add-on components and usually involve a material such as foam or a hollow pulse dampening chamber of synthetic flexible material. Some of these devices have a limited useful life due to the vulnerability of the material in the presence of hydrocarbons, and in any event add to the cost of the system due to their part and assembly cost when added into the system.

OBJECTS OF THE INVENTION

Accordingly, among the objects of this invention are to provide a pressure relief control system, method and apparatus for a pump pressurized fuel delivery system which rapidly and releasably controls the maximum system pressure of fuel delivered from the pump, reduces or eliminates system-induced pressure pulses and noise produced by the pump, requires few movable parts, and is rugged, durable, of relatively simple design and economical manufacture and assembly, and has a long in-service useful life.

A further object is to provide a by-pass pressure relief control system, method and apparatus of the aforementioned character also operable as pressure regulator in a no return fuel system which reduces the delay in fuel flow due to changing engine demand, reduces variation in pressure of fuel supplied to the engine, decreases the fuel line transmission of injector operational noise, can provide for accumulation of heated expanded fuel in the fuel rail and thereby relieve excessive pressure otherwise caused by the heated expanded fuel and which decreases vaporization of heated fuel during system shut off.

SUMMARY OF THE INVENTION

The present invention achieves the aforementioned objects by providing an improved pressure bypass relief control unit for a pump-pressurized fuel delivery system which eliminates or substantially reduces pressure pulses produced in the delivery line by the pump while preventing excessive over-pressure in the system.

The pressure relief control unit has a diaphragm received in a housing between a first pressure relief bypass chamber communicating directly or indirectly to the fuel tank or to pump fuel supply, and a second liquid fuel chamber continuously communicating with a fuel delivery line between an in-line check valve, downstream of the fuel pump outlet, and the fuel rail supplying the injectors. The diaphragm itself forms a normally closed valve cooperating with a relatively large diameter annular valve seat formed in the housing unit. When the unit is operating in the fuel delivery system solely as a bypass pressure relief control, the diaphragm valve, when opened by excessive system pressure and/or pulse-induced pressure peaks in the fuel delivery line, communicates the second liquid fuel chamber and hence the fuel delivery line with the first bypass chamber and thus bypasses fuel back to the pump fuel supply. When the unit is also operating continuously as the system fuel line pressure regulator, variations in fuel line pressure displace the diaphragm proportionally from the valve seat to continuously expel fuel proportionally from the fuel line via the second chamber and between the diaphragm valve and valve seat to bypass fuel via the first chamber back to the pump fuel supply. In addition, pressure peaks produced by the pump are modulated by being absorbed by the structures of the bypass pressure relief control unit.

In one embodiment, the annular valve seat with a fluid outlet is formed in the unit housing. In the valve-closed condition, an annular zone of an imperforate diaphragm normally directly bears on the annular valve seat to close the valve. When a system over-pressure and/or a pressure peak occurs, the increased fuel pressure proportionally displaces the annular zone of the diaphragm from the valve seat to expel the fuel through the outlet port to thereby bypass fuel from the fuel line/pump output back into the pump supply directly or via the fuel tank.

In another embodiment, the diaphragm bears on the valve seat as before. However, the fluid bypass outlet is located within the annular zone of the diaphragm itself so that when the seating zone of the diaphragm is displaced from the valve seat, fuel is expelled from the second, fuel-line-connected chamber through the diaphragm outlet and into the first or bypass chamber and thence out to the fuel tank or pump supply. The diaphragm has an always-exposed annular flexible convolution portion located radially outwardly of its annular seating zone which permits valve-opening and valve-closing travel of the diaphragm in the portion thereof functioning as a valve member relative to the valve seat, and also serves as a flexible bellows-like member for absorbing line pressure pulses, even in valve-closed condition. The diaphragm is operable as peelable-open seal form of poppet valve for smoothing pressure pulse peaks as well as allowing adequate fuel bypass flow to prevent excessive system over-pressure conditions and, if desired, to also continuously bypass regulate fuel line pressure to the injectors within close limits.

BRIEF DESCRIPTION OF THE DRAWINGS

The foregoing as well as other objects, features, and advantages of the present invention will be apparent from the following detailed description of the best mode, appended claims and accompanying drawings in which:

DETAILED DESCRIPTION

Figure 1:
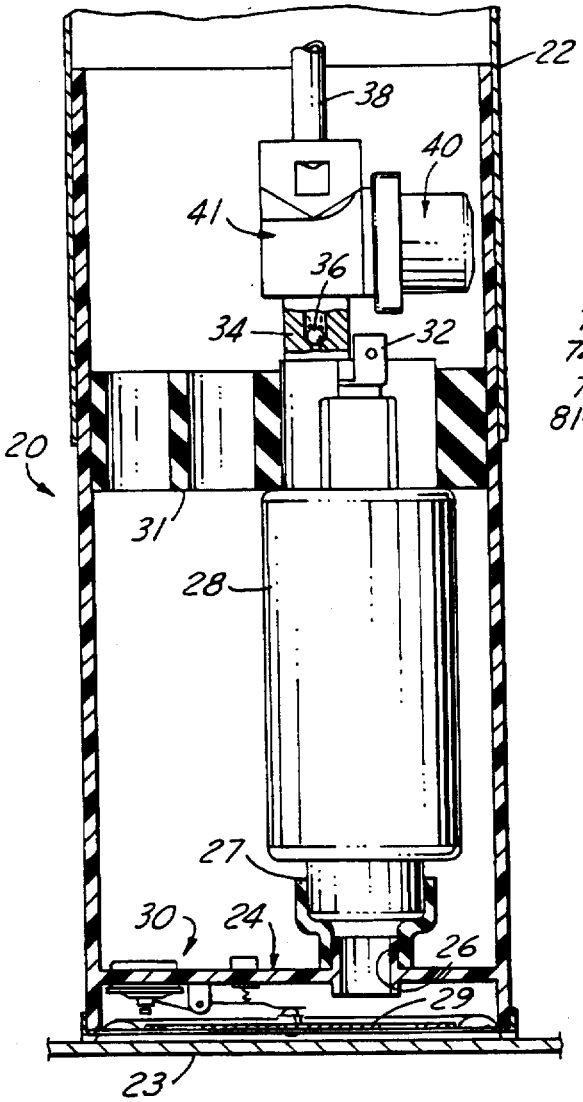
FIG. 1 is a part elevational and part vertical center sectional view of a fuel reservoir showing a fuel pump provided with one embodiment of a pressure control unit of this invention.

FIG. 1 illustrates an in-tank fuel reservoir canister 20 of known construction, preferably similar to that disclosed in U.S. Pat. No. 4,747,388, the disclosure of which is incorporated herein by reference. Canister 20 is shown in section with a locator sleeve 22 for positioning the canister within a vehicle fuel tank so that it rests on the fuel tank bottom 23. The canister has a raised support septum 24 with an integral short tube inlet 26 extending above and below the septum. A resilient connector nipple 27 supports the bottom of an electric pump 28 on tube 26. Liquid fuel flows from the tank into the inlet 26 through a diaphragm filter 29. A valve assembly 30 cooperates with filter 29 to assure a constant source of fuel at the pump inlet supplied from the interior fuel reservoir of the canister when the tank is near empty, and to prevent the admission of air into the pump such as when the vehicle sharply turns or travels a steep ascent or descent which would temporarily cause the liquid fuel to move from one side of the fuel tank to another and starve the fuel inlet.

The top end of the pump is mounted in a resilient collar 31 which is retained within the inner walls of the canister 20. The pump has an electrical connector 32 and a fuel outlet 34 having a spring based ball check valve 36 to allow fuel to flow from the pump but preventing reverse flow of fuel back to the pump outlet. The fuel is delivered from the pump output through check valve 36 to a fuel supply line 38 connected to a fuel rail supplying the engine fuel injectors (not shown).

A bypass pressure control unit 40 of the invention is mounted within the canister through a connector housing 41 for controlling the pressure within the fuel line 38. Housing 41 is suitably constructed to mount on pump outlet 34 and to connect with the inlet of fuel line 38 in bypass fuel flow relation to the fuel rail.

Figure 2:
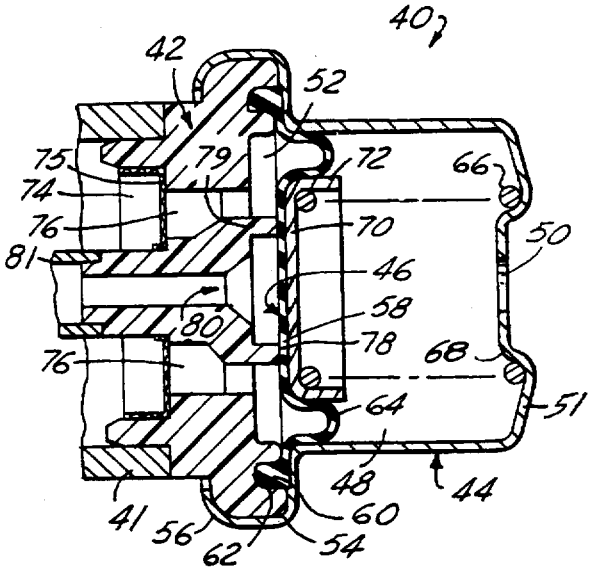
FIG. 2 is an enlarged fragmentary center cross-sectional view of the pressure control unit of FIG. 1 shown by itself.

Referring in more detail to FIG. 2, the pressure control unit 40 illustrative of a first embodiment of this invention comprises a one-piece body 42, which may be injection molded from lightweight plastic material or die-cast from aluminum, and a sheet metal cap 44, the body and cap together forming a housing that encloses a flexible diaphragm valve 46. The cap and the diaphragm define a spring vented chamber 48 which communicates with the ambient pressure in the headspace in fuel canister 20 through an outlet 50 in the end wall 51 of cap 44. Body 42 and diaphragm 46 define a first, normally-fuel-filled chamber 52 on the other side of the diaphragm continuously communicating with fuel line 38 and pump output. Cap 44 is secured by a cap flange 54 having a return bend 56 rolled around body 42 during manufacturing assembly of the components.

Diaphragm 46 is preferably a one-piece member having a relatively thin, flexible and flat imperforate circular central portion 58. Diaphragm 46 also has a circumferentially continuous encircling peripheral mounting rib 60 received in a groove 62 in body 42 and retained therein by cap flange 54 to provide a fluid tight seal between the body, cap and diaphragm. Preferably, to provide a more flexible and pressure responsive diaphragm, diaphragm 46 further has a circumferentially continuous pleat or bellows-like annulus portion 64 forming a convolution integrally interconnecting central portion 58 and rib 60 for relative movement therebetween and protruding for flexure into cap spring chamber 48. Preferably, diaphragm 46 is made of a flexible elastomer such as a fluorosilicone rubber or preferably an acrylonitrile butadiene rubber and may be reinforced with a fabric embedded in the elastomer. Diaphragm 46 is yieldably biased toward body 42 by a coil compression spring 66 disposed in cap chamber 48 and bearing at one end coil on cap end wall 51 and retained thereon by an annular shoulder 68 of wall 51. The spring bears at its other, opposite end coil against a presser member 70 in the form of shallow cup having an upturned flange 72 and sized to receive and retain the associated spring end coil.

Liquid fuel is admitted from the pump outlet to first chamber 52 through an annular recess 74 in body 42, which houses a screen or filter 75, and then through circumferentially spaced bypass inlet ports 76 in the body. In the valve-closed condition, an annular surface area of flat portion 58 of diaphragm 46 is forced by presser 70, as biased by spring 66, to firmly bear directly on a relatively large diameter annulus valve seat 78 formed centrally in body 42 so that diaphragm 46 itself functions as the movable valve member to thereby prevent and/or control bypass discharge of fuel from accumulator chamber 52. Diaphragm 46 is displaced from valve seat 78 when the fuel pressure in chamber 52 is sufficient to develop an unseating force on the working surface of diaphragm 46 exposed to chamber 52

(radially outwardly of valve seat 78) that exceeds the seating force exerted by spring 66. When any or all of the annular seating surface of diaphragm central portion 58 moves away from a sealed seating on the annular seating surface of valve seat 78, fuel is discharged from chamber 52, in bypass relation to fuel line 38, and flows between the diaphragm and valve seat and into a second or relief chamber 83 defined by the interior of annular valve seat 78 in valve seat pillar 79, and then through a restricted orifice passageway 80 extending coaxially in the valve seat pillar 79 from relief chamber 83 and back into the canister 20 through an outlet conduit or tube 81.

In operation as a bypass pressure relief control unit 40 reduces or eliminates pressure pulses in the line 38 as well as preventing excessive over-pressure in line 38. This is accomplished by the pressure-absorbing, volumetric expansion effect of the resiliently yieldable flexing diaphragm convolution 64 relative to fuel chamber 52 (even when the valve is closed) and/or by pressure peaks peelably unseating diaphragm 46 from valve seat 78. Partial or total unseating of diaphragm portion 58 from valve seat 78 connects line 38 via inlets 76 and first chamber 52 with bypass passageway 80 via second chamber 83. When this occurs any excess fuel pressure over a maximum system relief set point pressure, such as produced by pressure peaks in the line 38 due to such factors as injector shut off, pump output pulsation, and/or by heat-induced expansion of fuel or transient pressure pulses, is reduced or eliminated by such bypass release of fuel from chamber 52.

Normally, if pump 28 is operating under constant fuel flow conditions below relief set point pressure, unit 40 can be designed so that portion 58 of diaphragm 46 remains firmly sealably seated on valve seat 78 (FIG. 2) to prevent any fuel by-pass from line 38 and chamber 52 to relief passageway 80. Under certain conditions, such as when pressure pulses are developed by rotary pump 28, the peak pressure of the fuel in the line 38 increases periodically as pressure waves transit the fuel line. Such pressure waves are transmitted through the annular recess 74 and inlet ports 76 into chamber 52 to act against the active face of the annular convolution 64 of diaphragm 46. The diaphragm material of convolution 64 can yieldably and resiliently stretch to deform the convolution further into first chamber 48 in response to such pressure wave peaks to thereby dampen the same. However, whenever the fuel pressure within chamber 52 is of sufficient magnitude and duration to exert a force on diaphragm 46 that exceeds the force of spring 66, the diaphragm is disengaged from valve seat 78 to thereby bypass fuel from chamber 52 back to canister 20 through the relief chamber 83, thence through restricted orifice passageway 80 and thence through tube 81 until sufficient fuel is released to decrease fuel line pressure sufficiently to allow spring 60 to re-seat the diaphragm. Convolution 64 thus further flexes to accommodate travel of diaphragm portion 58 during opening and closing of fuel flow communication between chambers 52 and bypass outlet passageway 80.

When diaphragm 46 is forced by fuel pressure to disengage from valve seat 78, the force acting to urge the diaphragm against spring 66 increases due to the increased active surface area of the diaphragm against which the fuel may act, plus the pressure of fuel flowing through the outlet conduit 81 being reduced by the restricted orifice passageway 80. This increased force may be utilized to offset the increased biasing force of spring 66 as it is compressed, particularly if the same is an inexpensive variable rate spring. For any specific regulator construction, the desired minimum cross-sectional area of the orifice passageway 80 can be calculated to be in part a function of the spring rate of spring 66. Typically, the minimum cross-sectional area of the flow-controlling throat of the orifice passageway 80 is in the range of about 0.050" to 0.125".

The pressure control unit 40 is thus able to control the pressure in the fuel supply line 38 by expelling fuel from the line via chamber 52, past valve seat 78 and out through orifice passageway 80 via relief chamber 83 when fuel line pressure becomes excessive enough to lift the diaphragm 46 from the valve seat 78, such as when pressure pulses develop during the pumping cycle and/or when steady state line pressure exceeds the relief set point pressure.

It has been found that in operation of bypass regulator 40, as preferably located downstream of the pump outlet check valve 36 but preferably within canister 20, and hence well upstream of the fuel rail and associated injectors, fuel line pressure pulsations have been substantially reduced as compared to operation of a prior art regulator located downstream of the fuel rail, e.g., a pulse magnitude only 10% of the prior pressure amplitude excursion of ±2 psig. The relative contribution to these improved results of the pressure-absorbing effect of diaphragm convolution 64 versus pulse-induced seal pealing leakage between the diaphragm central portion 58 and valve seat 78 has as yet been undetermined, but both effects are believed to be significant factors in reducing fuel line pressure pulsations and pump noise.

Control unit 40 can also be designed to operate as a continuous bypass flow regulator, i.e., as the sole fuel line delivery pressure regulator in the fuel delivery system when pump 28 is of the type operated to produce a variable volume fuel output at a substantially constant output pressure. In such a fuel delivery system, as the diaphragm is variably displaced from valve seat 78, the increased bypass leakage flow area and increased active unseating working surface thereby exposed appear to produce a linear curve of bypass volumetric flow rate versus pressure within a narrow pressure variation range. Under such variable flow delivery rate conditions the diaphragm valve appears to operate continuously with a variable but slight leakage action, as contrasted to a large amplitude hunting and/or total pop-off action characteristic of rigid body pressure relief or regulating valves and pressure multiplier poppet valves. Hence this slight leakage mode of operation of the flexible diaphragm valve membrane is also believed to contribute to the improved continuous system pressure regulation within close limits while also providing a pulsation reduction effect. Nevertheless, under rapid, gross system pressure increases, diaphragm valve 46/78 can indeed rapidly pop-off or open much wider to quickly dump a large quantity of bypass fuel. Unit 40 can thus operate in the manner of a poppet valve due to the relatively large diameter annular geometry of valve seat 78 and the relatively large effective valve-unseating working area of the diaphragm exposed to fuel line flow. Preferably the annular seating surface of valve seat 78 defines a planar annulus surface lying in a plane perpendicular to the direction of force exerted on diaphragm 46 by spring 66 (i.e., axially of spring 66). Likewise, the cooperative seating surface of diaphragm central portion 58 is coplanar with the seating surface of valve seat 78 in valve closed condition.

It will be further noted that the relatively large diameter of the annular valve seat 78 enables a relatively large annular flow passage to be created between the valve seat and diaphragm portion 58 as it is unseated to allow fuel to flow from chamber 52 into passageway 80 via relief chamber 83. Hence a large variation in the effective annular flow-controlling cross-sectional area is achieved by a small range of regulating travel of diaphragm portion 58. It is believed that this feature is also a significant factor in achieving fuel line bypass pressure regulation within very close limits.

Additionally, the limited accumulator action provided by the yieldably resilient diaphragm convolution 64 can accommodate some temperature-induced expansion of fuel between closed check valve 36 and the closed injectors after engine shut off and prior to fuel line pressure reaching the relief set point pressure of regulator 40. This additional accumulator feature is advantageous in helping prevent injector or other system leakage during engine shut off/hot soak conditions.

Figure 3:
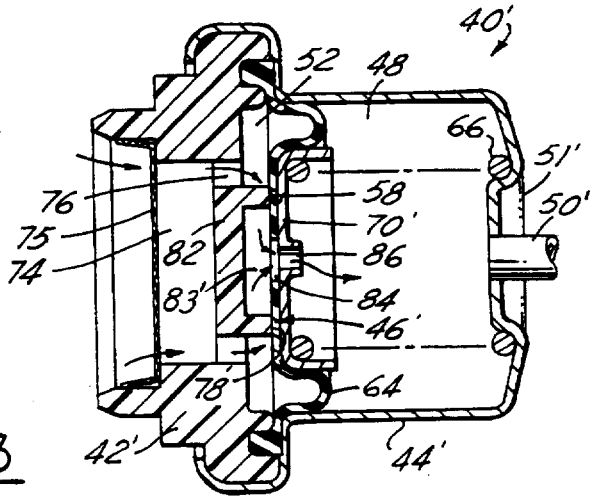
FIG. 3 is an enlarged center cross-sectional view of a second embodiment of the pressure control unit shown by itself.

In the second embodiment of the invention illustrated in FIG. 3, a modified pressure control unit 40' is shown which is similar to unit 40 seen of FIGS. 1 and 2 except that the diaphragm 46' rests on a modified valve seat pillar 82, i.e., one which has a closed back-wall-relief chamber 83' downstream of the valve seat, and a restricted bypass outlet from chamber 83 is formed in diaphragm 46' by a central opening 84 therein and an associated restricted orifice passageway 86 formed in a modified spring retainer presser member 70'.

In this second embodiment, as diaphragm 46' is biased by fuel pressure away from the valve seat 78 of pillar 82 the bypassed fuel is expelled from accumulator chamber 52 into spring chamber 48 through relief chamber 83' and the openings 84 and 86. From chamber 48 the bypassed fuel is expelled back into fuel canister 20 through an outlet tube 50'. As the flat central portion 58 of diaphragm 46' is disengaged from the valve seat 78, the effective area of the diaphragm against which the fuel acts increases. Hence an additional force is created by the bypass fuel entering between the valve seat 78, the closed back wall of chamber 83' of pillar 82 and the openings 84 and 86. When the pressure in fuel line 38 is thereby relieved and recedes sufficiently to reduce the diaphragm unseating force to less than the seating force produced by spring 66, diaphragm 46' is again biased by the spring to bring portion 58 into firm engagement with the annular valve seat 78 to seal accumulator chamber 52 from relief passageway chamber 48.

Figure 4:
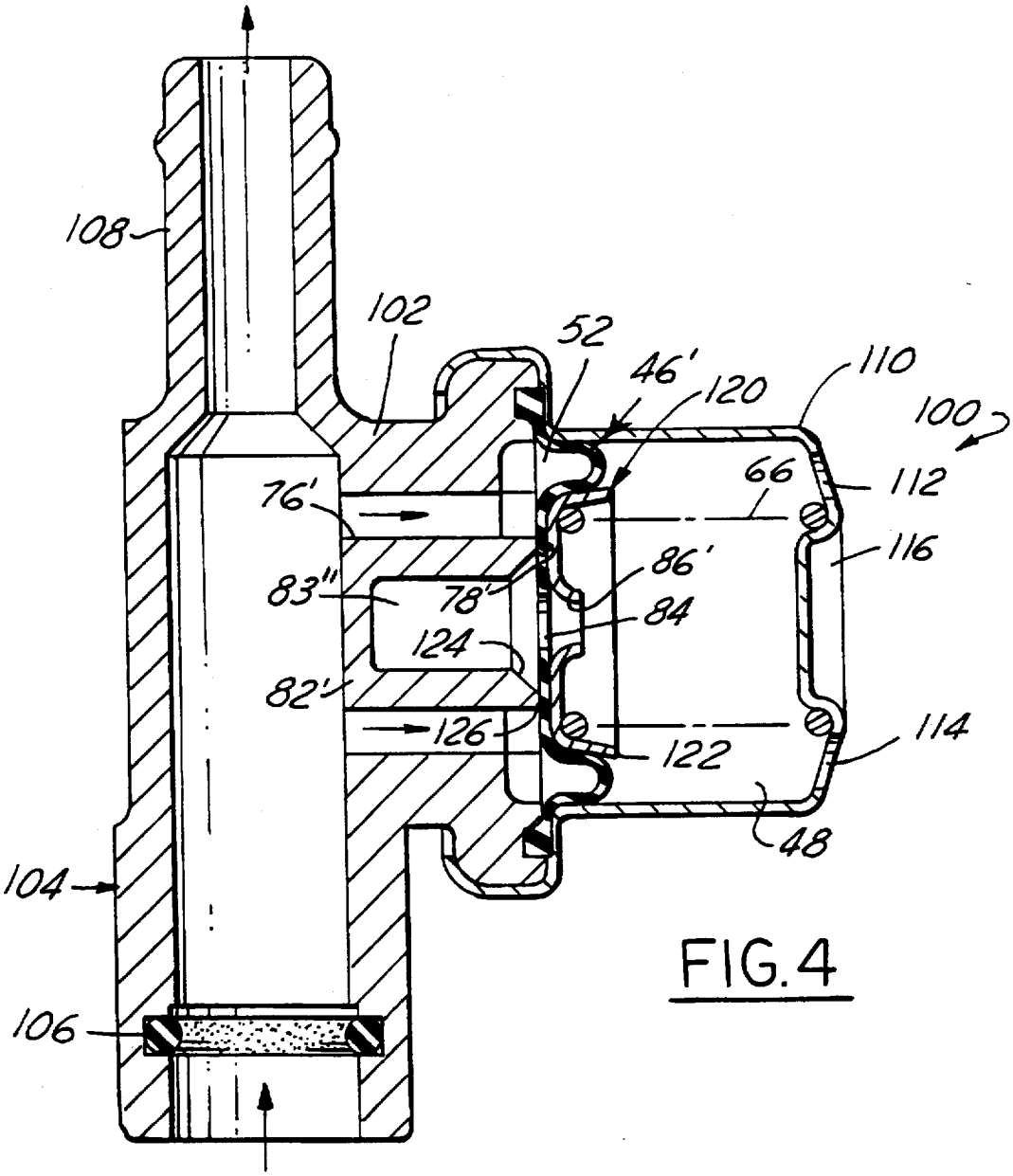
FIG. 4 is an enlarged center cross-sectional view of a third embodiment of the pressure control unit and associated housing shown by itself.

The third embodiment of the invention shown in FIG. 4 illustrates how the regulator 40' of FIG. 3 can be readily modified to provide a modified regulator 100 having a body 102 similar to bodies 42 and 42', but economically made as a one piece molded or die cast part integrally with an associated housing fuel line coupler part 104. The inlet end of coupler 104 may be provided with an O-ring seal 106 for mounting to the pump outlet, and the outlet end of the coupler formed as a hose nipple 108 for slip-on fit and clamping thereon of a fuel line hose (not shown).

Regulator 100 also has a slightly modified cap 110 in that outlet openings 112 and 114 may be provided in the end wall 116 of the cap radially outwardly of the spring 66. A plurality of openings 112, 114 may be provided equally spaced apart in a circular row to insure complete gravity fuel drainage from the cap regardless of its orientation on body 102. The spring base 120 of regulator 100, which serves as the spring retainer and diaphragm pressure member, is also slightly modified in that it is a sheet metal stamping having an outwardly flared peripheral flange 122 and a struck-out tapered nozzle forming the restricted passageway outlet 86'. The valve seat pillar 82' of regulator 100 has a modified valve seat 78' having a narrower annular flat or smoothly radiussed rib-like seating surface against which the central portion 58 of diaphragm 46' abuts in valve closed condition, as configured by convergent interior and exterior bevels or chamfers 124 and 126 formed on the valve seat end of pillar 82' converging at a flat narrow rim, or preferably at a radiussed crown rib seat.

From the foregoing description it will now be apparent that the various embodiments of the invention as described and illustrated hereinbefore amply fulfill the aforestated objects and provide numerous features and advantages. Constructing the bypass valve actuator and movable valve seat sealing member in one piece so as to be operable as both an actuating diaphragm and sealing valve member provides a substantial reduction in manufacturing cost over rigid body multi-part valve constructions, such as those disclosed in U.S. Pat. Nos. 5,220,941 and 5,265,644, while also reducing component size. In the embodiments of FIGS. 1, 3 and 4 the pump and control device are mounted together as one unit in a compact arrangement within the pump canister for dumping bypass fuel directly back into the canister reservoir. Valve durability and sealing characteristics are enhanced by the flexible nature of the diaphragm valve member itself directly engaging the annular valve seat 78. The large valve seating engagement area provided by the annular geometry of valve seat 78 renders valve operation more sensitive to pressure changes. That is, in the bypass pressure relief mode of operation the amplitude of pressure pulsations are reduced by controlled leakage release of fuel between the diaphragm and valve seat, characterized by a controlled intermittent minute leakage under partial valve-closed conditions to augment the dampening effect of the diaphragm bellows. The diaphragm bypass regulator of the invention thus can eliminate the need for add-on pressure pulse dampener devices by also performing their function of dampening pressure pulsations and limiting fuel line noise transmitted from either or both rotary pump and fuel injector operation.

The large diameter of the diaphragm valves of the regulators of the invention as compared to the relatively small diametrical dimension of prior in-line rigid body regulator valves, the integration of the actuating diaphragm with the valve seat sealing member, and the large diameter annular valve seat 78 cooperate to greatly enhance the sensitivity of valve operation for pressure pulsation dampening fuel leakage, primary bypass relief at system relief set pressure, and/or for continuous system delivery pressure regulation within close limits.

Pressure regulators embodying this invention thus have substantially improved responsiveness to rapid changes in the rate of flow of bypass fuel discharged from the regulator and provide substantially improved regulation of the pressure of fuel line delivery pressure in response to variations in the flow of the bypass fuel discharged from the regulator. For example, in a regulator embodying this invention operating with a constant pump outlet fuel pressure having a nominal value of about sixty pounds per square inch gauge, the actual pressure variation or drop was only about one to three PSI over the range of variation of the fuel flow rate from zero to thirty gallons per hour. This regulator was constructed in accordance with the embodiment disclosure of FIG. 4 with valve seat 78 having a diameter of about 0.185 inches, and an outside diameter of the diaphragm 46', in the portion thereof exposed to fuel, of about 0.700 inches. The annular pocket of the cap 110 in which the spring 66 is received had an inside diameter of about 0.700 inches and an axial height of about 0.600 inches. The diaphragm compression spring 66 produced a nominal force of about seventeen pounds with the diaphragm valve closed, and had as low a spring rate as practical within these parameters. The diametrical cross-sectional area of valve seat 78 was about 0.268 square inches, and the controlled restriction throat diameter of passageway 86' was about 0.082 inches.

Although the invention is described in conjunction with presently preferred embodiments thereof illustrated in the drawings, it will be appreciated that many alternatives and modifications may be implemented without departing from the general principles of the invention. For example, the bypass regulator units need not be contained within canister 20 in accordance with the invention in its broadest aspects, although such construction is presently preferred for reasons previously set forth. In addition, the construction of regulator unit 40 lends itself to application of engine manifold pressure to chamber 48, should this be desired in certain applications, as by substituting closed cap 44' with its tube 50' for cap 44 in unit 40. Depending upon the particular fuel injection and control system with which this modified regulator is used, the fluid chamber 48 can be connected to communicate via tube 50' with (1) ambient atmosphere to compensate for varying atmospheric conditions under which the engine operates, (2) the combustion air intake manifold (see also U.S. Pat. No. 5,265,644) to provide a substantially constant differential pressure for supplying liquid fuel to fuel injectors or the like (with the regulator preferably mounted on or close to the engine intake manifold and outlet conduit 81 heat insulated and/or properly led away from the adverse influence of engine heat), or to a source of compressed air or other gas to vary and control the pressure under which liquid is applied to the fuel injectors in response to varying engine demand, load and other operating conditions.

What is claimed is:

1. A method of delivering fuel to an internal combustion engine that includes:

a fuel supply with a fuel pump responsive to application of electrical power for supplying fuel under pressure, fuel delivery means on the engine, a fuel line having one end connected to an outlet of said pump and a second end connected to said fuel delivery means, a check valve in said fuel line for preventing reverse flow of fuel from said delivery means to said pump, fuel bypass means coupled to said fuel line between said second end of said fuel line and said check valve for providing a regulated fuel bypass flow path from said pump outlet parallel to said line, such that fuel continues to flow through said bypass means and said pump continues operation in the absence of fuel demand at said fuel delivery means, said method comprising the steps of:

(1.) providing a flexible diaphragm valve made from a planar sheet of flexible fuel impervious material of uniform thickness and an associated rigid annular valve seat, (2.) arranging said diaphragm to be in continuous communication with the fuel delivery line, (3.) arranging said valve seat relative to the diaphragm valve to form an annular valve seat barrier to control communication between the fuel line and the bypass flow path by flow of fuel radially inwardly of and across said annular valve seat and between said diaphragm valve and valve seat, (4.) yieldably biasing said diaphragm to directly bear on said valve seat to sealably isolate the fuel line from the fuel bypass path, (5.) causing said diaphragm valve and valve seat to operate conjointly such that when force of fuel pressure in the fuel line overcomes the biasing force exerted on said diaphragm, said diaphragm is disengaged from said valve seat to open communication of the fuel line with the fuel bypass outlet path via said valve seat, and vice versa when the spring force overcomes such fluid pressure force.

2. A bypass pressure control unit for a fuel delivery system for an internal combustion engine having a fuel pump with its output connected to a fuel delivery line of the system comprising:

a housing, a flexible diaphragm valve made from a planar sheet of flexible fuel impervious material of uniform thickness and defining with said housing a first chamber and a second chamber, said housing having at least one port defining a fuel inlet adapted for continuous communication between the fuel delivery line and said first chamber, a fuel bypass outlet port communicating with said second chamber, a rigid valve seat formed in said housing between said chamber, a spring in said housing for biasing said diaphragm to directly bear on said valve seat to sealably isolate said first chamber from the fuel bypass outlet port via said second chamber, and said diaphragm, spring and valve seat being constructed and arranged such that when force of fluid pressure in said first chamber overcomes the force exerted by said spring on said diaphragm, said diaphragm is disengaged from said valve seat to thereby open communication of said first chamber with the fuel bypass outlet port via said second chamber, and vice versa when the spring force overcomes such fluid pressure force; to thereby regulate the pressure of fuel in said fuel delivery line, and wherein said valve seat is in the form of an annulus defining with said diaphragm when sealably engaged thereon an annular valve seat barrier between said first and second chambers.

3. The pressure control unit of claim 1 wherein the fuel outlet port is formed in the housing.

4. The pressure control unit of claim 3 wherein the fuel outlet port includes restricted orifice means downstream of said valve seat constructed and arranged such that when said diaphragm is displaced from said valve seat said first chamber communicates with said restricted orifice means.

5. The pressure control unit of claim 2 comprising a rigid presser member associated with said diaphragm against which said spring bears to bias said diaphragm into direct engagement with said valve seat.

6. The pressure control unit of claim 5 wherein the fuel outlet port is formed in said diaphragm and said presser member.

7. The pressure control unit of claim 6 wherein said fuel outlet port is formed as an opening in said diaphragm and an opening in said presser member aligned with said diaphragm opening and sized to form a restricted orifice in said fuel outlet port, such that when said diaphragm is displaced from said valve seat said first chamber communicates with the diaphragm and presser member openings.

8. The pressure control unit of claim 7 wherein said housing has a spring chamber enclosing said spring and having an opening therein defining said fuel bypass outlet port that communicates with said first chamber when said diaphragm disengages from said valve seat.

9. The pressure control unit set forth in claim 2 wherein said valve seat barrier has a relatively large diameter annular seating surface generally coplanar with a valve-seat-engaging portion of said diaphragm when sealably seated on said seat annular surface, said seating surface and said diaphragm being constructed and arranged to create a relatively large variation in bypass fuel flow controlling cross-sectional area for a relatively small valve-opening and valve closing travel increment of said diaphragm valve-seat-engaging portion.

10. The pressure control unit of claim 9 wherein said spring comprises a coil spring arranged coaxially with said valve seat annulus.

11. The pressure control unit set forth in claim 2 wherein said pressure control unit housing comprises a base portion and a fuel line connector portion integral with one another and having passageways in said base portion and a fuel line passage in said connector portion, said passageways in said base portion defining said first chamber, said valve seat and said second chamber, said housing further including a cap affixed to said base portion and constructed and arranged therewith to define a spring chamber containing said spring and sealably clamping said diaphragm between said base portion and said cap.

12. The pressure control unit of claim 2 wherein said diaphragm includes a flexible convolution portion having one surface in constant communication with said first chamber and an opposed surface in constant communication with a reference pressure chamber in both the open and closed conditions of said diaphragm relative to said valve seat.

13. The pressure control unit of claim 12 wherein said housing includes a cap in which said spring is mounted for operable biasing engagement with said diaphragm, said cap and said diaphragm being mounted to said housing as a sealed unit to provide a sealed chamber enclosing said spring and forming said reference pressure chamber, said chamber being filled with a gaseous medium at a predetermined pressure to modulate the biasing force of said spring relative to said diaphragm.

14. The pressure control unit of claim 12 wherein the material of said diaphragm convolution portion is resiliently yieldable.

15. The pressure control unit of claim 13 wherein said diaphragm annular convolution portion extends in encircling relation to said spring and generally coaxial therewith, and is constructed and arranged to permit yieldable expansion and contraction of said first chamber in response to fuel pressure variations in said first chamber and to accommodate valve-opening and valve-closing travel of said diaphragm.

16. The pressure control unit of claim 2 including in combination therewith a vehicle fuel tank, a fuel pump canister mounted in said tank, a rotary fuel pump mounted in said canister, said pressure control unit being mounted on the outlet of said rotary fuel pump within the confines of the fuel pump canister and in bypass fuel communication with a reservoir in said fuel pump canister.

17. A fuel delivery system for an internal combustion engine that includes a fuel supply with a pump responsive to application of electrical power for delivering fuel under pressure, an engine air intake manifold, fuel delivery means coupled to said fuel supply for controlled delivery of fuel from said supply to said manifold, pressure regulator means having an inlet means responsive to fuel pressure at said fuel delivery means and outlet means connected through a fuel return to said supply, said regulator means being responsive to a predetermined pressure differential across said fuel delivery means for passing excess fuel through said return to said supply, characterized in that said regulator means comprises:

a flexible diaphragm valve made from a planar sheet of flexible fuel impervious material of uniform thickness, and an associated rigid valve seat defining with said outlet means and said inlet means a first chamber and a second chamber respectively, spring means for biasing said diaphragm to directly bear on said valve seat to sealably isolate said first chamber from said bypass outlet means via said second chamber, and wherein said diaphragm, spring and valve seat are constructed and arranged such that when force of fuel pressure in said first chamber overcomes the force exerted by said spring on said diaphragm, said diaphragm is disengaged from said valve seat to open communication of said first chamber with the fuel bypass outlet means via said second chamber, and vice versa when the spring force overcomes such fuel pressure force, to thereby regulate the pressure of fuel in said fuel delivery means, and wherein said valve seat is in the form of an annulus defining with said diaphragm when sealably engaged thereon an annular valve seat barrier between said first and second chambers.

18. The system of claim 17 wherein the fuel outlet means includes restricted orifice means downstream of said valve seat constructed and arranged such that when said diaphragm is displaced from said valve seat said first chamber communicates with said restricted orifice means.

19. The system of claim 17 comprising a rigid presser member associated with said diaphragm against which said spring bears to bias said diaphragm into direct engagement with said valve seat.

20. The system of claim 19 wherein the fuel outlet means includes a port formed in said diaphragm and said presser member.

21. The system of claim 20 wherein said fuel outlet port is formed as an opening in said diaphragm and an opening in said presser member aligned with said diaphragm opening and sized to form a restricted orifice in said fuel outlet means constructed and arranged such that when said diaphragm is displaced from said valve seat said first chamber communicates with the diaphragm and presser member openings.

22. The system of claim 17 wherein said valve seat barrier has a relatively large diameter annular seating surface generally coplanar with a valve-seat-engaging portion of said diaphragm when sealably seated on said seat annular surface, said seating surface and diaphragm being constructed and arranged to create a relatively large variation in bypass fuel flow controlling cross-sectional area for a relatively small valve-opening and valve-closing travel increment of said diaphragm valve-seat-engaging portion.

23. The system of claim 22 wherein said spring comprises a coil spring arranged coaxially with said valve seat annulus.

24. The system of claim 17 wherein said diaphragm includes a flexible convolution portion having one surface in constant communication with said second chamber and an opposed surface in constant communication with a reference pressure chamber in both the open and closed conditions of said diaphragm relative to said valve seat.

25. The system of claim 24 wherein the material of said diaphragm convolution portion is resiliently yieldable.

26. The system of claim 25 wherein said diaphragm annular convolution portion extends in encircling relation to said spring and generally coaxial therewith, and is constructed and arranged to permit yieldable expansion and contraction of said second chamber in response to fuel pressure variations in said second chamber and to accommodate valve opening and closing travel of said diaphragm.

27. The system of claim 17 including in combination therewith a vehicle fuel tank, a fuel pump canister mounted in said tank, said pump comprising a rotary fuel pump mounted in said canister, said regulator means being mounted on the outlet of said rotary fuel pump within the confines of the fuel pump canister and in bypass fuel communication with a reservoir in said fuel pump canister.

* * * * *

UNITED STATES PATENT AND TRADEMARK OFFICE

CERTIFICATE OF CORRECTION

PATENT NO. : 5,727,529
DATED : March 17, 1998
INVENTOR(S) : Charles H.Tuckey

It is certified that error appears in the above-identified patent and that said Letters Patent is hereby corrected as shown below:

Col 4, Lines 22-23, change "spring vented chamber 48" should be "vented spring chamber 48".

Col 10, Line 35, change "claim 1" to "claim 2".

Col 12, Line 46, change "second chamber" to "first chamber".

Col 12, Lines 56,57, change "second chamber" to "first chamber".

Signed and Sealed this

Second Day of May, 2000

*Attest:*

Q. TODD DICKINSON

*Attesting Officer*

*Director of Patents and Trademarks*